US007730583B2

(12) United States Patent
Salice

(10) Patent No.: US 7,730,583 B2
(45) Date of Patent: Jun. 8, 2010

(54) FURNITURE HINGE WITH DAMPING DEVICE

(75) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 392 days.

(21) Appl. No.: 11/913,082

(22) PCT Filed: Mar. 12, 2007

(86) PCT No.: PCT/EP2007/052271

§ 371 (c)(1),
(2), (4) Date: Oct. 30, 2007

(87) PCT Pub. No.: WO2007/104731

PCT Pub. Date: Sep. 20, 2007

(65) Prior Publication Data

US 2008/0201906 A1 Aug. 28, 2008

(30) Foreign Application Priority Data

Mar. 16, 2006 (IT) ..... RM2006U0054

(51) Int. Cl.
*E05D 7/00* (2006.01)

(52) U.S. Cl. ..... 16/286; 16/262; 16/387; 16/288; 16/50; 16/54

(58) Field of Classification Search ..... 16/286–288, 16/50, 54, 56, 82, 294, 387, 262, DIG. 21; 188/268, 271, 290, 291, 296, 322.5, 281, 188/282.5, 282.8, 282.9
See application file for complete search history.

(56) References Cited

U.S. PATENT DOCUMENTS

| | | | | |
|---|---|---|---|---|
| 4,449,269 | A * | 5/1984 | Sundermeier et al. | 16/50 |
| 4,550,470 | A * | 11/1985 | Omata | 16/85 |
| 4,938,322 | A * | 7/1990 | Sugasawara et al. | 188/290 |
| 7,127,778 | B2 * | 10/2006 | Salice | 16/354 |
| 7,328,484 | B2 * | 2/2008 | Salice | 16/354 |
| 7,395,580 | B2 * | 7/2008 | Brustle et al. | 16/50 |
| 2007/0136990 | A1 * | 6/2007 | Salice | 16/282 |
| 2008/0276426 | A1 * | 11/2008 | Salice | 16/333 |

FOREIGN PATENT DOCUMENTS

| | | | |
|---|---|---|---|
| DE | 10211294 | | 9/2003 |
| EP | 1255013 | A2 * | 11/2002 |
| WO | WO 03/087512 | A1 * | 10/2003 |

* cited by examiner

*Primary Examiner*—Chuck Y. Mah
(74) *Attorney, Agent, or Firm*—Glifford, Krass, Sprinkle, Anderson & Citkowski, PC

(57) ABSTRACT

Furniture hinge with damping and/or braking device in alternative to those already existing and capable of guaranteeing an improved efficiency during the closing or opening operation of the doors, or other furniture parts, thanks to an improvement of the kinematic motion for transmitting motion from one of the rockers to the damping elements. The improved efficiency of this hinge is also obtained by increasing the friction surfaces with a viscous medium present in suitable areas of the hinge and by allowing regulation of the trend of the angular velocity of a circular shaped element, for example a disc, which acts as braking element in contact with the viscous medium.

19 Claims, 7 Drawing Sheets

FURNITURE HINGE WITH DAMPING DEVICE

FIELD OF THE INVENTION

The present invention relates to a furniture hinge, in particular a hinge with spring for doors, or in general for furniture parts suitable to be brought into motion, provided with a damping device which acts during opening and/or closing of the doors.

STATE OF THE ART

Furniture provided with doors or wings to close compartments and which open by pivoting about a horizontal or vertical axis uses various types of hinge. A type which is very widely used today is one in which the hinges to support the doors in the closed position are not visible from the outside of the piece of furniture when the door is closed.

Hinges of this type are today commonly used in the furniture industry as they have a series of advantages, which have determined their extensive use on the market. Some embodiments of known hinges are provided with springs of various types to produce a return force during closing or a pushing force during opening of the doors to which they are fitted. This allows very precise closing or opening of the doors.

Nonetheless, damping and/or braking devices of the door movement caused by the elastic reaction of the spring are desirable in these hinges. The object of these devices is above all to prevent noise caused during closing operations by doors banging shut against the body of the piece of furniture.

There are currently various known damping and braking devices integrated in furniture hinges. However, these devices have some drawbacks.

In particular, in some hinges motion is transmitted by one of the rockers to the damping elements of the damping device by the use of a slider, substantially rectangular in shape. This slider must reconcile two opposing characteristics: on the one hand it must have good rigidity so that the lower surface thereof meshes as much as possible without deformations in the grooves of the damping elements, and on the other hand it must have sufficient elasticity to allow bending during the return movement thereof to exceed the edges of these grooves without allowing said damping elements to rotate. If the working and coupling tolerances of the components are not sufficiently precise, this can lead to poor operation of the damping device due to irregular behaviour or to possible idle travel of the slider.

In particular, jerks can occur during the return movement, producing an annoying noise that can be heard from the outside.

One solution to the problem, described in document DE10211294, provides for two rotating discs operated by the slider and immersed in a viscous medium, but the damping effect that is obtained is not satisfactory.

Therefore, there is a need to produce a hinge provided with a damping device which is capable of overcoming the aforesaid drawbacks.

SUMMARY OF THE INVENTION

The object of the present invention is to produce a furniture hinge with a damping and braking device in alternative to those already existing, guaranteeing an improved efficiency and greater silence during the closing and/or opening operation of the doors, or other furniture parts, thanks to an improvement of the kinematic motion for transmitting the motion to the damping disc.

A further object is to make the device simple to produce and mount on the hinge, without variation to the overall dimensions of standard hinges.

Therefore, the present invention proposes to resolve the problems discussed above by producing a furniture hinge with damping device having the characteristics set forth in claim 1.

The hinge of the invention comprises a damping device in which a slider, controlled in translation by a connection element between the hinge and said damping device, acts with a tappet element on a first underlying disc causing this to rotate. This first disc is advantageously solidarity fixed to an annular gripping element that in a first direction of rotation of the hinge is suitable to act by means of radial interference with a second disc in contact with a decelerating fluid element. This generates a friction such as to make the two discs integral with one another only in this first direction of rotation. In the opposite direction of rotation of the hinge the gripping element no longer acts with the second disc, releasing the latter from the first disc.

In the device according to the invention, the slider can advantageously perform a translational movement only, without being subject to any elastic jerky deformation, which can generate undesirable noise. The forward and return movements thereof correspond to rotations of the first disc, respectively in the two opposite directions. The annular gripping element is housed on this first disc, said element preferably consisting of an elastic element, that during the rotation in a first direction is deformed so as to adhere to walls of the second disk, pressing on these until it pulls the second disc due to friction. In the opposite direction of rotation, the elastic element is returned to its original condition, so that its pressure on the second disc is annulled and the latter remains fixed in its place.

The improved efficiency of the hinge of the present invention is obtained by increasing the friction surfaces with a viscous medium present in suitable areas of the hinge and/or by allowing regulation of the trend of the angular velocity of one or more disc shaped elements, which act as braking elements in contact with the viscous medium.

Another advantage is represented by the fact that the damping device of the hinge of the invention forms a separate element which can be mounted, already assembled, with extreme ease in different embodiments of the hinge, even in very different embodiments, on the base of a box element, or simply box, of standard type. In fact, as in the hinge of the invention the box element is separated from the damping device, it does not contribute towards the damping actions and can be produced with standard materials, for example simply by stamping, and does not require the use of more costly materials particularly suitable for damping.

From a production viewpoint all this implies that on a first production line it is possible to continue producing standard type hinges, while assembly of the damping device on said hinges, when required, is performed separately on a second independent line. Consequently, it is unnecessary to provide lines dedicated entirely to the production of hinges with integrated damping device.

Moreover, while assembly of state of the art hinges provides for subsequent mounting on the box element of the elements forming the damping device one at a time, in the hinge of the invention said device, already assembled separately, is mounted on the base of the box of the hinge with a single, simple and quick operation. The box element therefore does not act as supporting element during mounting of the elements of the damping device.

In an advantageous embodiment, fixing of said device to the box is performed using the same two pins forming the articulation of the hinge rockers with the box, in the case of a hinge of the articulated quadrilateral type, or using the single pin forming the articulation of the fixing arm with the box, in the case of a single pin hinge.

The standard box element is advantageously provided with an opening on the base thereof and has a shape suitable for quick assembly with different embodiments of the damping device. Moreover, in order to produce hinges provided with damping device it is sufficient for one of the two rockers, or the fixing arm directly, to be provided on the first production line with a connection element capable of interacting, through the opening on the base of the box element, with a slider of the damping device. This connection element can, for example, be formed by one end of the same rocker or by the same fixing arm, or by tabs provided thereon, or by a separate element however connected to the rocker or to the fixing arm, or inserted thereon and pivoting about the respective pin.

Finally, a further advantage is that said damping device, thanks to its compactness and to the fact that it is mounted on the base of the box element, is incorporated inside the thickness of the furniture door and is therefore invisible when the door is opened, also improving the aesthetic appearance.

The dependent claims describe preferred embodiments of the invention.

BRIEF DESCRIPTION OF THE FIGURES

Further characteristics and advantages of the invention will be more apparent in the light of the detailed description of preferred, although non-exclusive, embodiments of a furniture hinge with damping device illustrated, by way of a non-limiting example, with the aid of the accompanying drawings wherein.

DETAILED DESCRIPTION OF PREFERRED EMBODIMENTS OF THE INVENTION

Figure 1A:
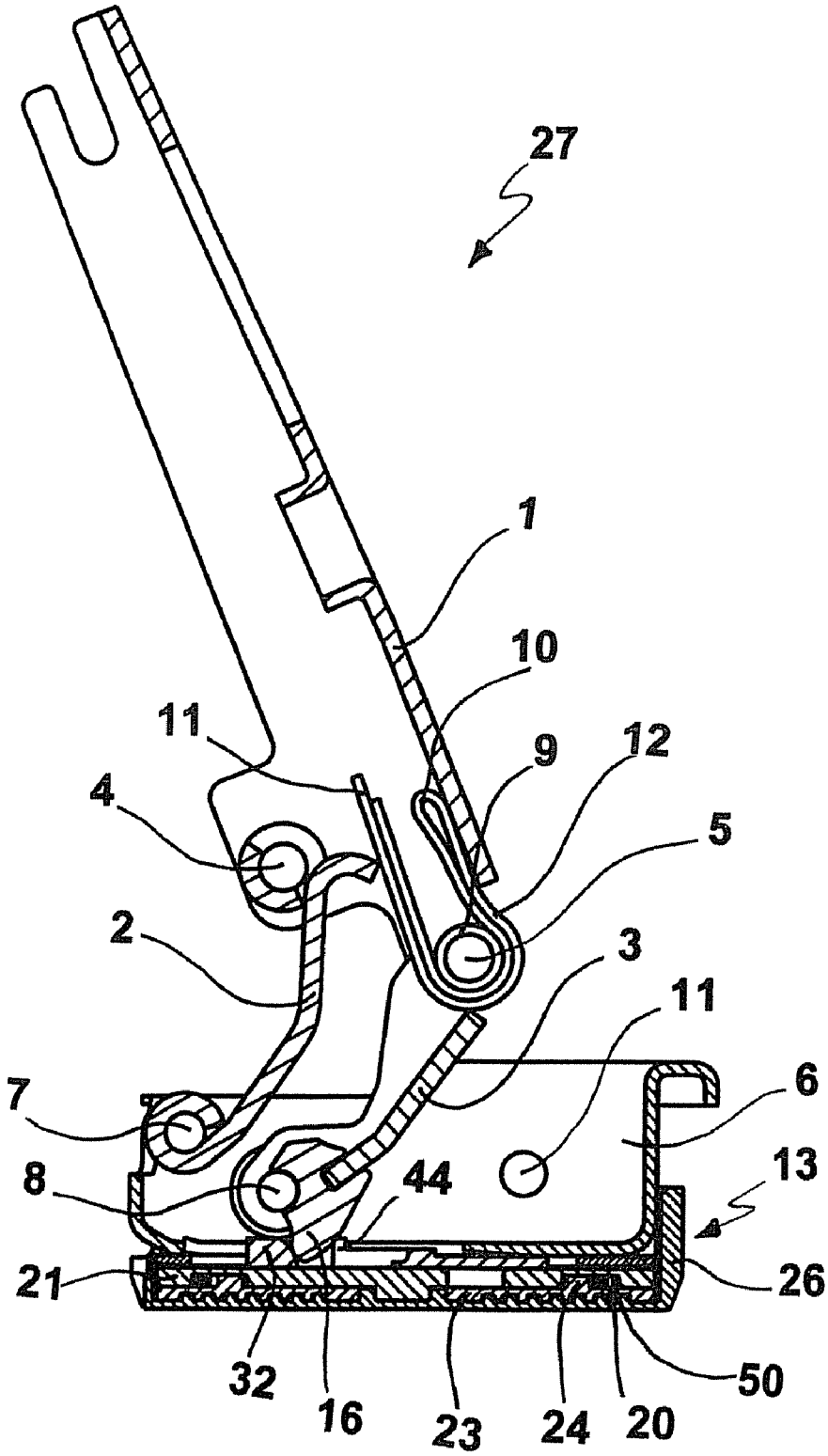
FIGS. 1*a* and 1*b* show sectional views of a first hinge of the invention in two different positions.
Figure 1B:
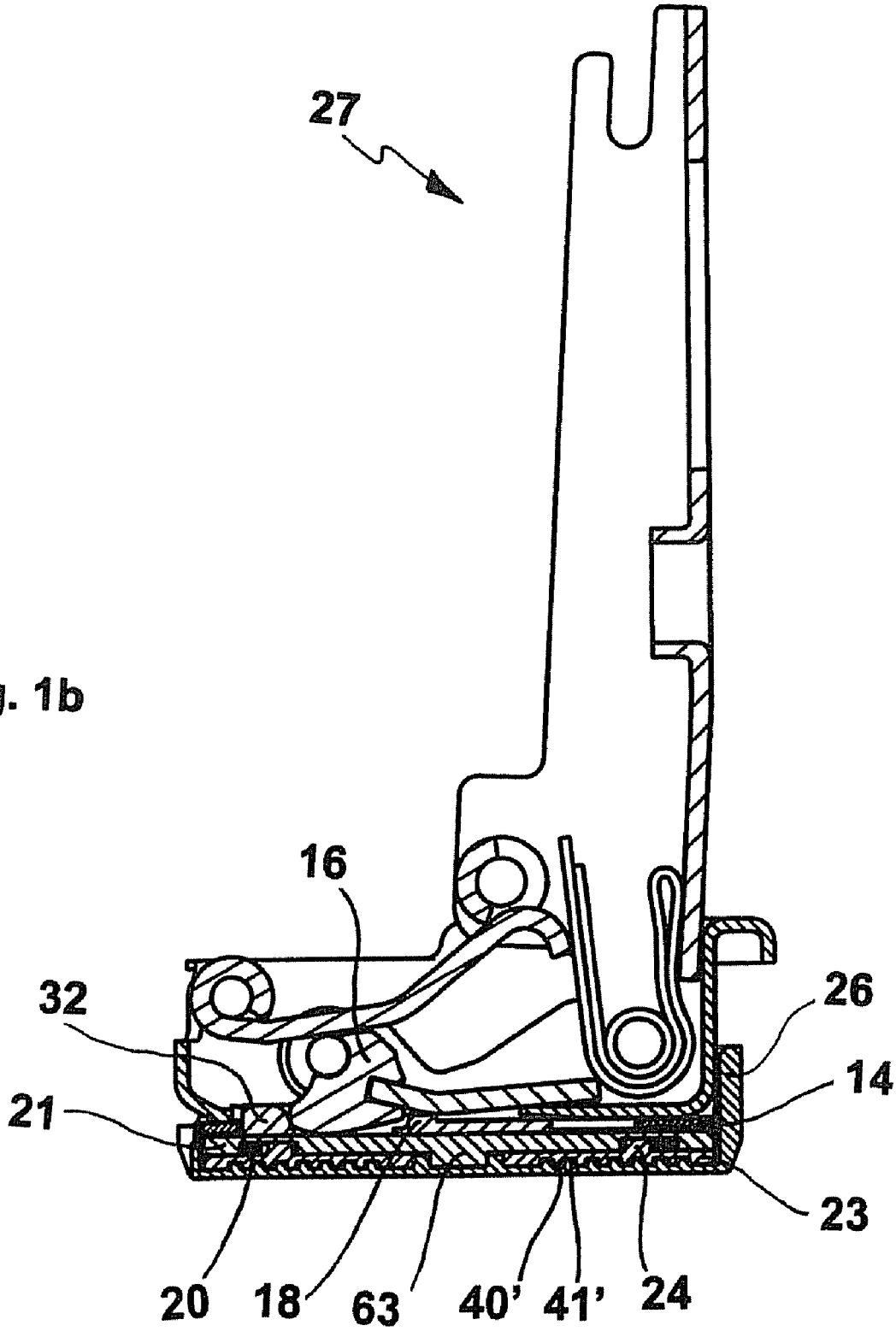

With reference to FIGS. 1*a* and 1*b*, a first embodiment of the hinge is represented, indicated as a whole with the reference 27, said hinge comprising a fixed element, or hinge arm 1, which is fixable on a base, or plate, in turn solidarity fixed to a bearing wall of a side panel or any suitable element of a piece of furniture. The hinge is provided with two rockers 2 and 3, with a respective first end thereof pivoting about two respective pins 4, 5 housed in holes in the side walls of the arm 1. The arm 1 is connected to a box element 6, fixed in a cavity produced in the inside wall of the door or wing of the piece of furniture, or of any other appropriate pivoting element of the piece of furniture. The two respective second ends of the rockers 2 and 3 are housed in rotation on two other respective pins 7, 8 with axes parallel to the first two pins 4, 5. The four pins 4, 5, 7, 8 form an articulated quadrilateral.

Around the articulation pin 5, connecting the rocker 3 to the arm 1, there is provided an elastic element or spring 9. One of the arms 10 of said elastic element is resting on the hinge arm 1, while the other arm 11 reacts on the rocker 2.

Closing of the arms 10, 11 of the elastic element 9 is established so that this element exerts a pushing force on the rocker 2 until the position shown in FIG. 1*a*. Beyond this opening angle of the door, approximately from 15 to 20°, the elastic element 9 has a compression with a negligible application arm, so that the remaining part of the pivoting movement of the door takes place freely without being influenced by the presence of elastic forces.

On the other hand, in the closing phase of the door, the elastic element 9 produces a return force in the closing direction which allows a precise and spontaneous closing of the door in the final angular space, with an amplitude of approximately 15 to 20°. FIG. 1*b* shows a cross-sectional view of the hinge in the door closed position.

A bushing 12 can be appropriately interposed between the elastic element 9 and the pin 5. Alternatively, the element 9 can be detached from the pin 5 and be anchored in a known way to the hinge arm 1.

On the base of the box element 6 there is mounted advantageously a damping and/or braking device 13 suitable to reduce jerky movements which are generated during the opening and/or closing phases of the doors, reducing noise and allowing these phases to take place comfortably and smoothly.

Said damping device 13 comprises a housing formed of an appropriately shaped casing 14 to allow fixing thereof to the box element 6, and of a bottom or base 26. Inside said housing there are advantageously inserted a slider, a first disc, an annular gripping element, preferably elastic and solidarity fixed to with the first disc, and a second disc immersed in a highly viscous medium, such as grease. Advantageously, the casing 14 and the base 26, in the pre-mounted position, are held together by means of appropriate projections 19 of the casing, that engage in corresponding slots 17 on the base. The damping device, already assembled, can be provisionally pre-mounted on the box element 6 of the hinge by means of shanks 10, provided on the inside walls of the casing 14, that engage in corresponding holes 11 on the walls of the box element 6. The definitive fixing of the damping device 13 on the box element 6 is performed by means of the same pins 7, 8, pivoting respectively about which are the second ends of the rockers 2 and 3. Said pins 7, 8 pass through the holes 70, 80 of the casing 14, and the corresponding holes on the box element 6.

The base of the casing 14 is provided with a hole or opening 15, which is substantially rectangular or square or of another shape, to allow a cam connection element 16, fixed to the lower end of the rocker 3 pivoting about the pin 8 for articulation with the box element, or forming an integral part of said rocker, to engage with the slider 18, thus controlling said slider in translation in a first or second direction in correspondence with the direction of rotation of the hinge.

In the movement of the hinge comprised between the positions illustrated in FIGS. 1*a* and 1*b*, the cam element 16 pushes against the projection 32 of the slider 18 in the closing phase, while side teeth (not illustrated in the drawings) push on the edges 44 of the slider in the opening phase, causing the translation of the slider respectively in opposite directions.

The lower surface of the slider 18 is provided with a tappet element 25, for example in the form of a pin, that engages in a groove or slot 33, substantially oval in shape, of the first disc so as to transform a translation of the slider into a corresponding rotation of said first disc.

Figure 3:
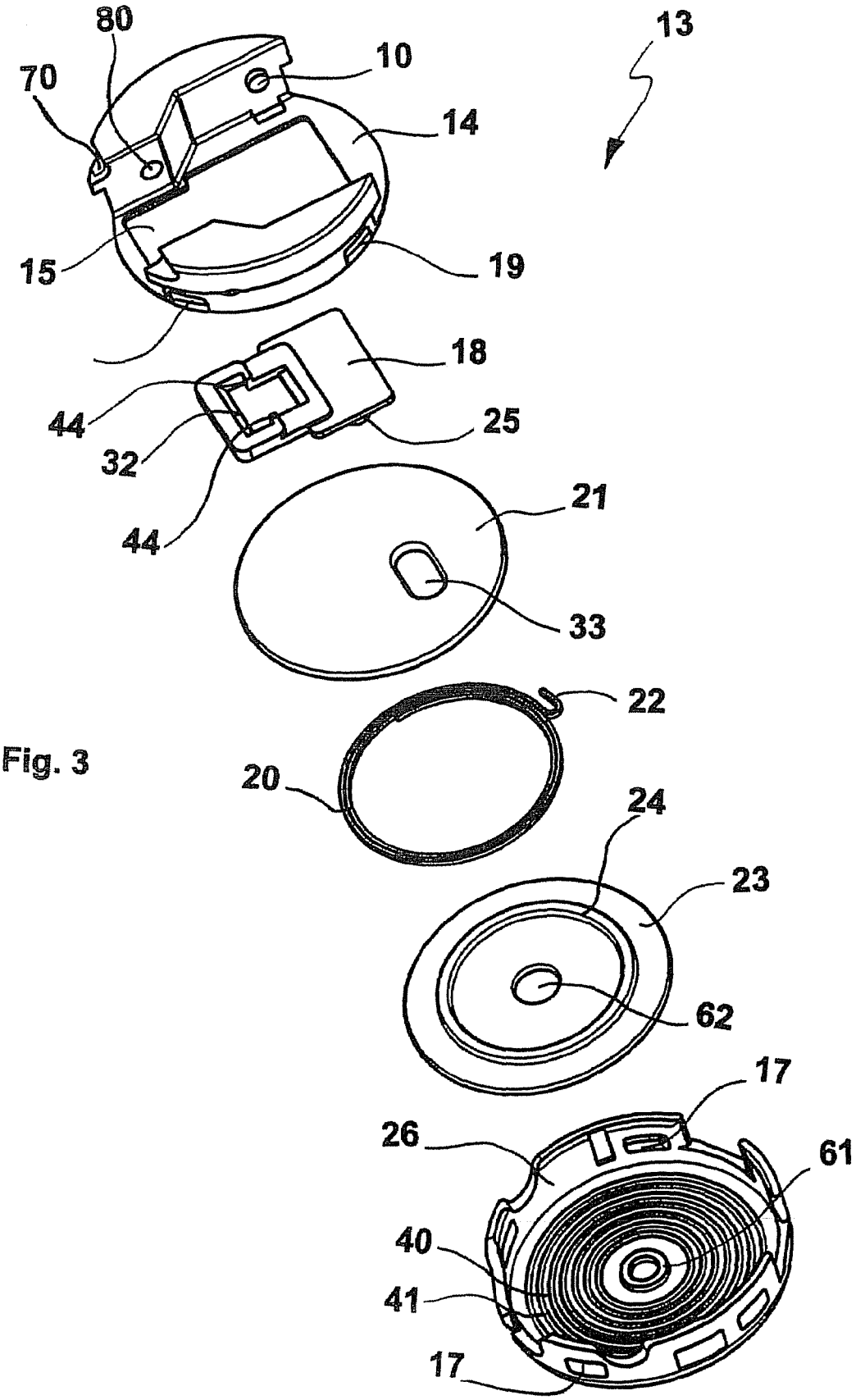
FIG. 3 shows an exploded view of a first embodiment of a component of the hinge in FIG. 1.
Figure 4:
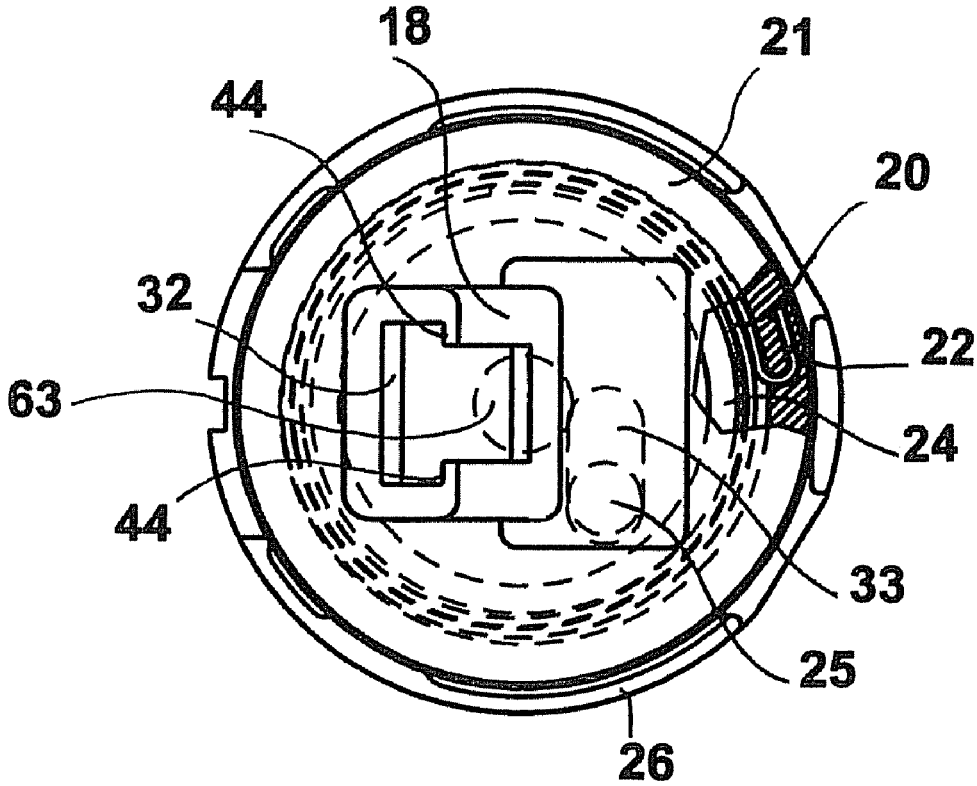
FIGS. 4 and 5 show plan views of the inside of the component in FIG. 3 corresponding respectively to the two positions of the hinge in FIGS. 1*a* and 1*b;*
Figure 5:
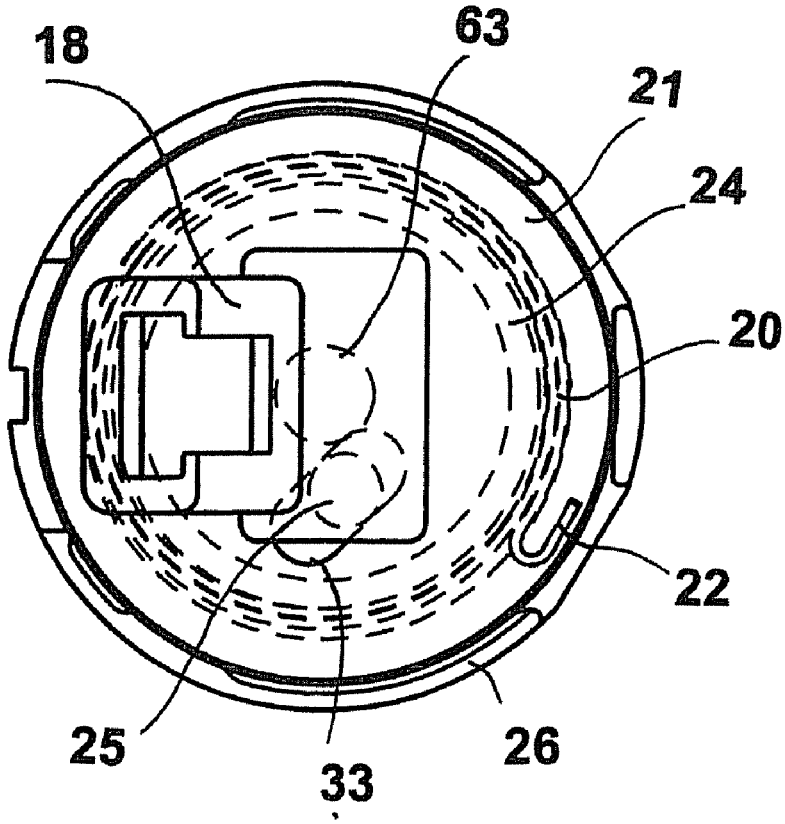

A first advantageous alternative embodiment of this first embodiment of the hinge according to the invention comprises a damping device 13, illustrated in FIGS. 3 to 5, provided with the slider 18, of a substantially rectangular shape, and with the first 21 and second disc 23. In this embodiment the elastic annular gripping element consists of a coil spring 20, which is substantially flat.

The lower surface of the first disc 21 is provided with an annular groove 60, as illustrated more clearly in FIGS. 1*a* and 1*b*. In the assembled position, this annular groove 60 receives:

the coil spring 20, fixed in correspondence with its outside end with a hook 22 to the first disc 21, and a projecting annular profile 24 on the upper surface of the second disc 23, so that the coil spring 20 adheres internally to the outside wall of the annular profile 24.

During the hinge closing movement, the first disc 21 pulls the hook 22 of the spring 20. The spring 20 thus wraps around the annular profile 24 creating a frictional force such as to make the second disc 23 rotate and exert the braking action. On the other hand, during the hinge opening movement, the spring 20 is uncoiled releasing the pressure on the second disc 23, to allow the first disc 21 to return to its original position without making the second disc 23 rotate.

FIGS. 4 and 5 show plan views of the positions of the components of the device 13, without the casing 14, corresponding to FIGS. 1*a* and 1*b*. FIG. 4 shows a partial sectional view of the first disc 21 to illustrate the hook 22 of the coil spring 20 that makes said spring solidarity fixed with the first disc.

Figure 6:
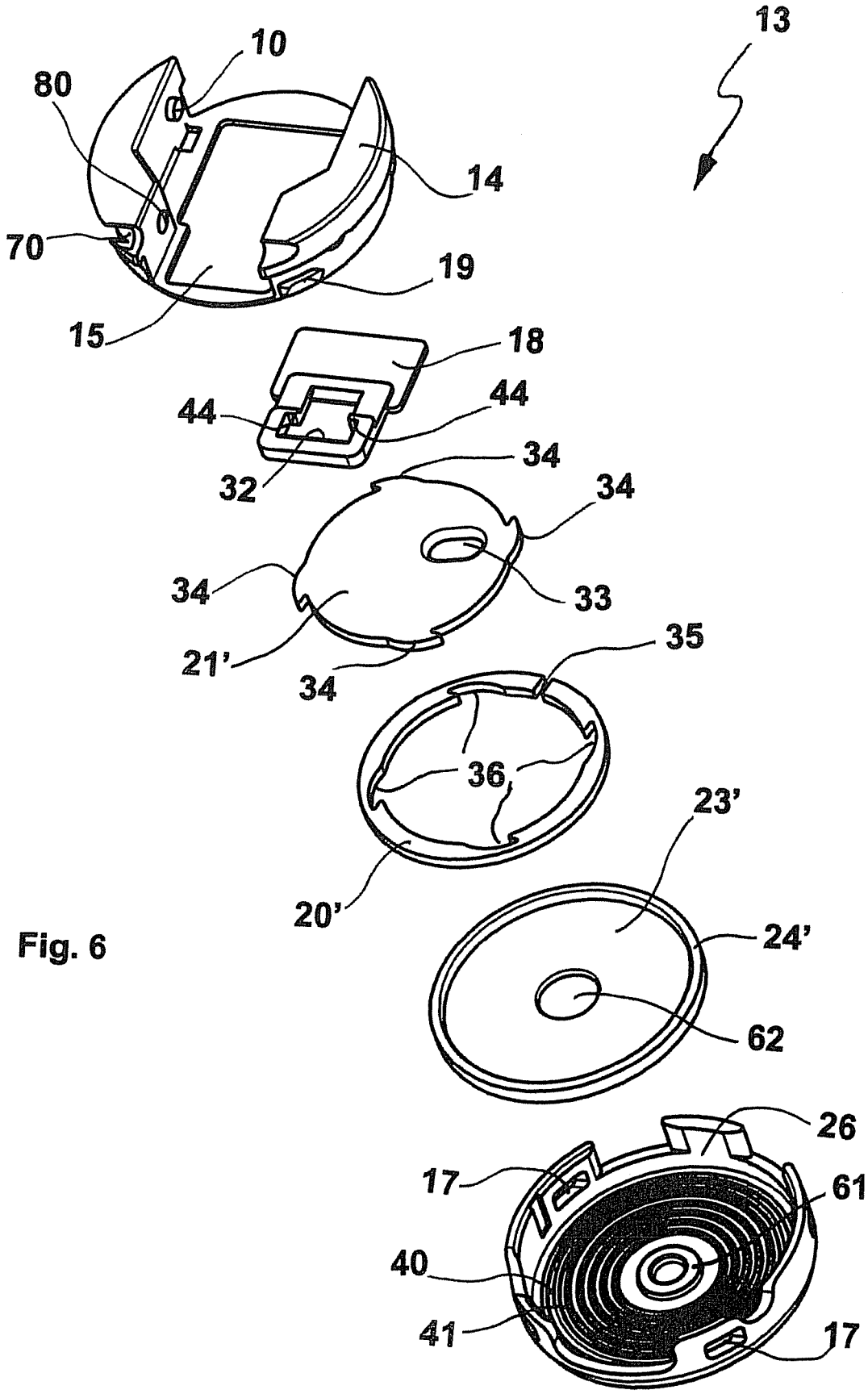
FIG. 6 shows an exploded view of a second embodiment of the component in FIG. 3.
Figure 7:
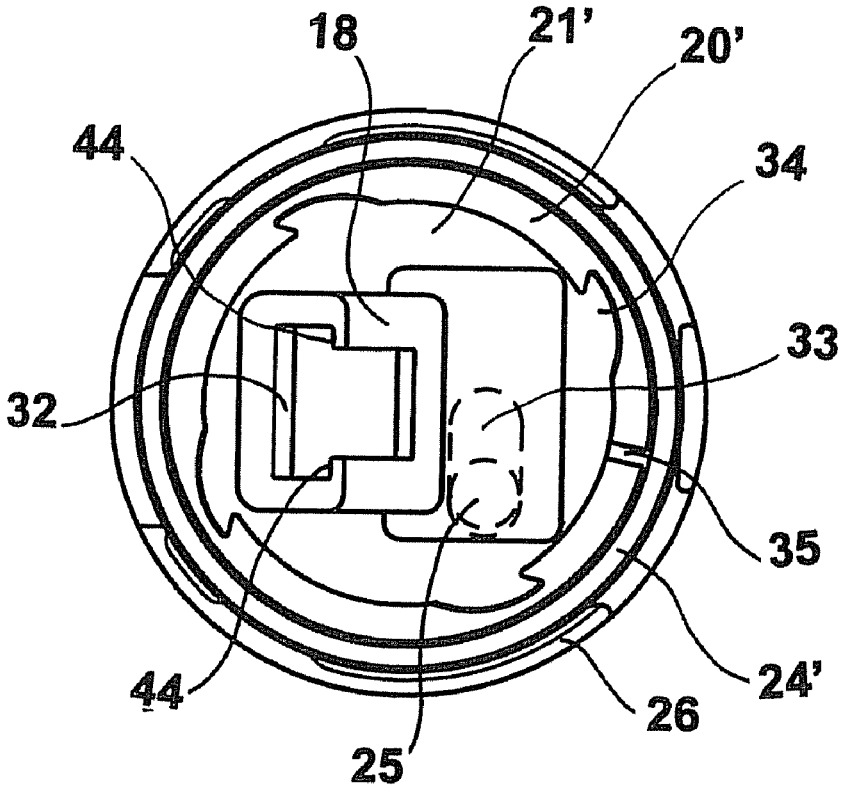
FIGS. 7 and 8 are plan views of the inside of the component in FIG. 6 corresponding respectively to the two positions of the hinge in FIGS. 1*a* and 1*b*.
Figure 8:
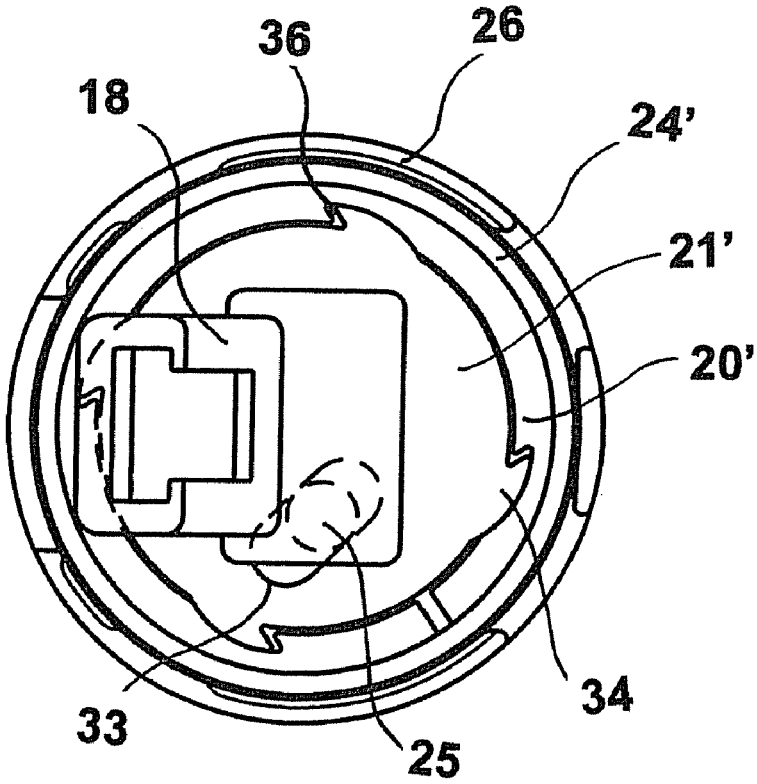

A second advantageous alternative embodiment comprises a damping device 13', illustrated in FIGS. 6 to 8, provided also in this case with the slider 18, a first disc 21', and a second disc 23'. However, in this alternative embodiment, the annular gripping element consists of a flat ring 20', adhering to and concentrically arranged with respect to the first disc.

The first disc 21' has a smaller diameter than the first disc 21 of the previous alternative embodiment and is provided with teeth 34 on its perimeter. These teeth 34 have an outside edge that is partly curved and partly rectilinear.

The flat ring 20' of elastic material has a cut 35 in a point of the perimeter thereof. The inside edge of the ring 20' is provided with grooves 36 having a shape complementary to the teeth 34 of the first disc 21'. In the assembled position of the device, the grooves 36 receive inside the teeth 34 of the disc 21', and first disc 21' and ring 20' are housed in the space of the upper surface of the second disc 23' delimited by a projecting annular profile 24'. In this case the profile 24' is situated along the peripheral edge of the second disc 23'.

FIGS. 7 and 8 show plan views of the positions of the components of the damping device, without the casing 14, corresponding to the partially open and closed configurations of the hinge.

In FIG. 7 it can be observed that, with the hinge open, the inside edge of the elastic ring 20' adheres to the outside wall of the first disc 21', while there is a predetermined clearance between the outside edge thereof and the inside wall of the profile 24'.

With the translation of the slider 18 from its position in FIG. 7 to the closed position illustrated in FIG. 8, the first disc 21' is made to rotate in a clockwise direction. The teeth 34 push on the surfaces of the grooves 36 making the elastic ring 20' dilate, so that the outside surface thereof presses against the inside surface of the profile 24' creating the friction necessary to make the second disc 23' rotate and exert the braking action.

During the opening phase, on the other hand, the teeth 34 bring the elastic ring 20' back into its original position, that is adhering to the first disc 21', and the slider 18 returns to the position in FIG. 7 but without pulling the braking disc 23' into rotation.

Figure 2:
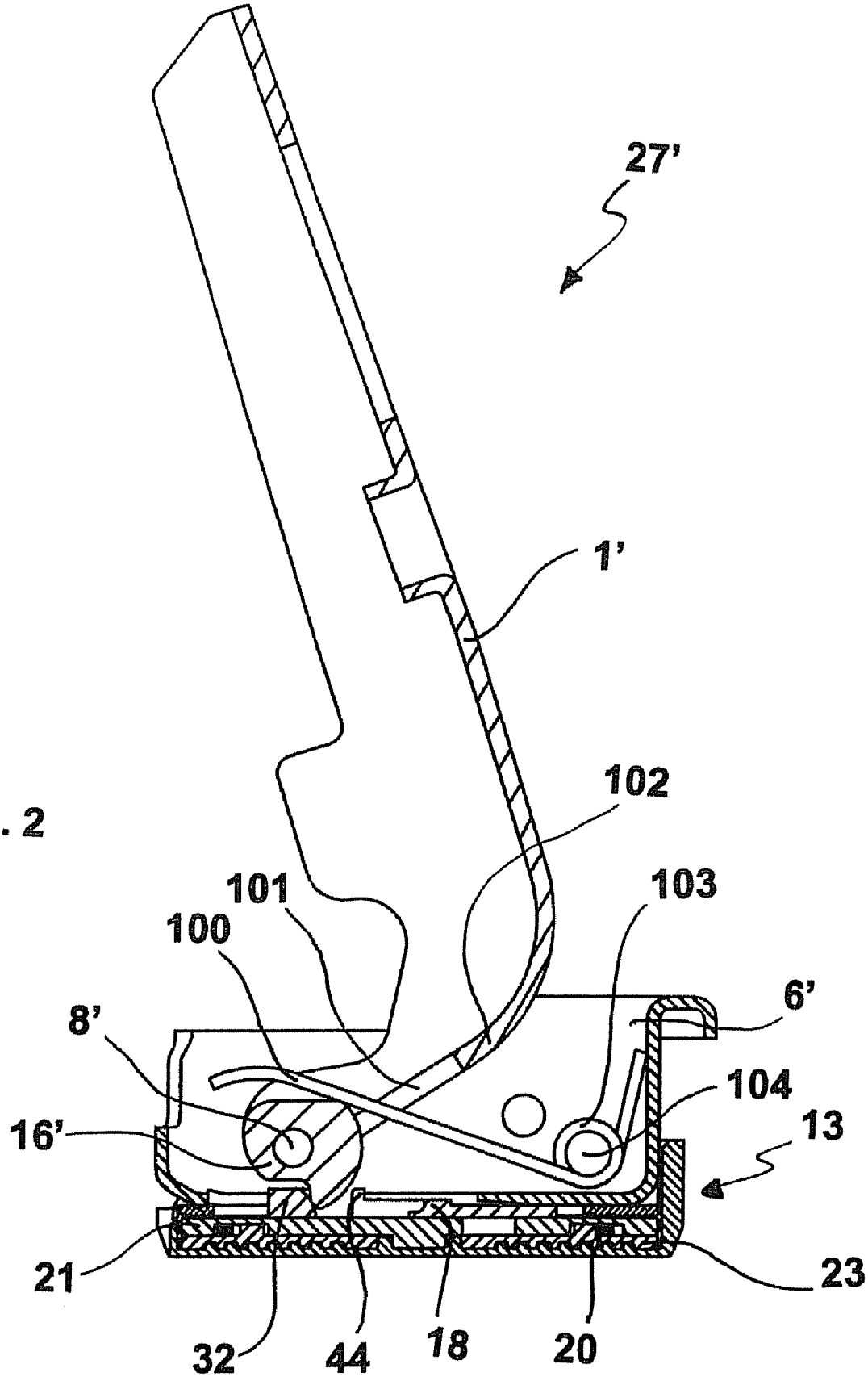
FIG. 2 shows a sectional view of a second hinge of the invention.

A second embodiment of the invention provides for application of the same damping device 13, in both the alternative embodiments described, to a hinge 27' with one single articulation pin 8', shown in FIG. 2.

Unlike the hinge 27 of the articulated quadrilateral type described previously, the hinges with one single pin are provided with a fixing arm 1', substantially L-shaped, comprising in a single block the arm 1 and the rocker 3 of the hinge 27, and suitable to pivot about the articulation pin 8' with the box element 6'. As is known, the rockers 2 and 3 and the other articulation pins 4, 7, 5 are therefore not provided. FIG. 2 shows a torsion spring 103 wrapped around a further transverse pin 104 and provided with an arm 100 which rests on an edge of the connection element 16', acting as a cam, in order to supply the closing thrust to the hinge. More appropriately, a pair of specular adjacent springs 103 can be provided, the central arms 100 of which passing through a central cavity 101 located in the bent part 102 of the fixing arm 1' of the hinge 27'.

Considering this second embodiment of the hinge, in FIGS. 1*a* and 1*b*, the element indicated with the reference 3 represents, therefore, a portion or end of the L of the fixing arm 1'.

In this second embodiment, the cam connection element 16', fixed to the end or bent part 102 of the fixing arm 1' or which is an integral part of said end, engages depending on the direction of rotation with the projection 32 or with the edges 44 of the slider 18. The transmission of the rotating motion to the first disc 21, 21' and the radial interference of the annular elastic gripping element 20, 20', solidarity fixed to the first disc, with the second disc 23, 23' exerting the damping action all take place in the same way as described above. Moreover, in case of a hinge with one single pin, the definitive fixing of the damping device 13 to the box element 6' is performed by means of the single pin 8' that passes through a hole 80 of the casing 14 and a corresponding hole on the box element 6'.

In all the alternative embodiments the discs 21, 21' and 23, 23' are provided, for the centering thereof, respectively with a lower central shank 63 and with a corresponding hole 62 that adhere respectively to the inside and outside cylindrical surfaces of a projecting ring 61 provided in a central position on the base 26.

The facing surfaces of the second disc 23, 23' and of the bottom 26, between which a viscous medium is provided, are provided with a series of complementary annular concentric grooves 40', 40 and ribs 41', 41, which can be coupled as indicated in FIGS. 1*a* and 1*b*. The flat part of the crests of the ribs and the base of the grooves can, moreover, be produced with a rough finishing to promote adhesion of the viscous medium, for example high viscosity grease, in contact therewith. Advantageously, this embodiment makes it more difficult for the grease to move in a radial direction, so that the use of gaskets between the bottom 26 and the box element 6 of the hinge is unnecessary. In fact, the same braking effect obtained with known devices can be obtained using a smaller quantity of grease or, alternatively, an increased braking effect can be obtained with the same quantity of grease.

Besides eliminating possible deficiencies in the operation of the damping device in abnormal conditions, a further advantage of the hinge of the invention is to make the device undoubtedly silent and the braking force more effective thanks to the increased extension of the coupled and friction surfaces with the viscous medium. The hinge of the invention also allows efficient operation without variation to the overall dimensions of standard hinges, considering the great compactness of the damping device 13.

Advantageously, the production costs of the hinge of the invention are considerably low; in fact, the hinge described has a great advantage from the structural viewpoint, namely that it comprises a damping device which forms a separate body and can therefore be mounted, already assembled separately, on the box element.

The box element can be of the type normally used to produce standard hinges, for example produced simply by stamping and provided in some cases with projections of reference which do not prevent conventional use of the hinge without any damping and/or braking device. This device, already assembled, can be combined with the box element chosen in the final assembly phase of the hinge, the pins 7, 8 or the only pin 8' being advantageously the essential elements used for fixing thereof. Therefore, it is possible to produce the hinge of the invention provided with damping device without having to provide for particular operations with respect to assembly of standard hinges. In fact, only a single fixing operation is required to hold together the box element of the hinge and the damping device. Moreover, the latter has the advantage of disappearing entirely inside the thickness of the door and of being invisible from the outside.

The invention claimed is:

1. Furniture hinge comprising a first member for fixing to an element of a piece of furniture, a second member for fixing to a door of said piece of furniture, comprising a box, said first member being suitable to move with a relative pivoting motion about a first articulation pin with said box, a connection element connecting said first member to damping means for damping said pivoting motion, said damping means comprising a slider operated in translation by said connection element, a first disc suitable to rotate about an axis, kinematic means for converting the translation of the slider into a rotation of the first disc about the axis, a second disc suitable to rotate about the axis and immersed in a viscous medium, the hinge being characterized in that it is provided with an annular gripping element cooperating with said first disc in the course of the rotation thereof and suitable to grip the second disc due to radial interference, pulling said second disc into said rotation so as to produce a damping force with the viscous medium.

2. Hinge according to claim 1, wherein the annular gripping element is suitable to grip the second disc in a single direction of rotation of the hinge.

3. Hinge according to claim 2, wherein said annular gripping element comprises a substantially flat coil spring, housed in an annular groove, provided on the lower surface of the first disc, and fixed at one end thereof to said first disc.

4. Hinge according to claim 3, wherein said annular groove is such as to also house an annular profile provided on a first surface of the second disc so that the coil spring adheres internally to an outside wall of said profile.

5. Hinge according to claim 2, wherein said annular gripping element is a flat elastic ring arranged concentrically on the outside of the first disc.

6. Hinge according to claim 5, wherein said ring is provided with a cut in a point of its perimeter and is provided on its inside edge with grooves of a shape that is complementary to projections provided on the outside edge of the first disc.

7. Hinge according to claim 6, wherein ring and first disc are housed in a space of a first surface of the second disc delimited by a peripheral annular profile.

8. Hinge according to claim 2, wherein said first member comprises two elements, the first of said elements being a fixing arm for fixing to said element of piece of furniture and the second of said elements being a first rocker suitable to pivot about the first articulation pin with said box and about a second articulation pin with said fixing arm, and there is provided a second rocker suitable to pivot about a respective first articulation pin with said box and about a respective second articulation pin with said fixing arm.

9. Hinge according to claim 1, wherein said kinematic means for converting the motion comprise a tappet element provided on the slider and a cavity provided on the first disc.

10. Hinge according to claim 9, wherein said first member comprises two elements, the first of said elements being a fixing arm for fixing to said element of piece of furniture and the second of said elements being a first rocker suitable to pivot about the first articulation pin with said box and about a second articulation pin with said fixing arm, and there is provided a second rocker suitable to pivot about a respective first articulation pin with said box and about a respective second articulation pin with said fixing arm.

11. Hinge according to claim 1, wherein said damping means comprise a housing separated from said box, in turn comprising a casing and a bottom which enclose the slider, the first disc, the annular gripping element and the second disc, said casing and bottom being able to be held together in the pre-assembly phase by means of projections of the casing suitable to engage in corresponding slots on the bottom.

12. Hinge according to claim 11, wherein there are provided centering means for centering the first and second discs with the bottom.

13. Hinge according to claim 12, wherein the bottom is provided with ribs and grooves complementary to corresponding grooves and ribs provided on a second surface of the second disc.

14. Hinge according to claim 13, wherein the box is provided with holes suitable to house shanks of the casing for a pre-assembly operation of the housing to the box.

15. Hinge according to claim 14, wherein said damping means are provided with quick connection means so that said housing, assembled separately and pre-mounted, forms a single element suitable to be fixed to said box in a single mounting operation.

16. Hinge according to claim 15, wherein said quick connection means comprise the first articulation pin, suitable to engage a first hole of the casing and a corresponding second hole of the box.

17. Hinge according to claim 11, wherein said damping means are provided with quick connection means so that said housing, assembled separately and pre-mounted, forms a single element suitable to be fixed to said box in a single mounting operation.

18. Hinge according to claim 17, wherein said first member comprises two elements, the first of said elements being a fixing arm for fixing to said element of piece of furniture and the second of said elements being a first rocker suitable to pivot about the first articulation pin with said box and about a second articulation pin with said fixing arm, and there is provided a second rocker suitable to pivot about a respective first articulation pin with said box and about a respective second articulation pin with said fixing arm.

19. Hinge according to claim 18, wherein said quick connection means comprise the first articulation pins, suitable to engage first holes of the casing and corresponding second holes of the box.

* * * * *